US005797292A

United States Patent [19]

Johansson et al.

[11] Patent Number: 5,797,292

[45] Date of Patent: Aug. 25, 1998

[54] DOMER APPARATUS FOR A CAN BODY MAKING APPARATUS

[75] Inventors: Bert E. Johansson; Connie M. Grims, Sr., both of Golden, Colo.

[73] Assignee: Coors Brewing Company, Golden, Colo.

[21] Appl. No.: 640,671

[22] Filed: May 1, 1996

[51] Int. Cl.[6] ..... B21D 22/00

[52] U.S. Cl. ..... 72/348

[58] Field of Search ..... 72/347, 348, 349, 72/465, 466

[56] References Cited

U.S. PATENT DOCUMENTS

| | | | |
|---|---|---|---|
| 3,771,345 | 11/1973 | Paramonoff | 72/349 |
| 4,183,237 | 1/1980 | Schaffer | 72/349 |
| 4,733,550 | 3/1988 | Williams | 72/348 |
| 4,790,169 | 12/1988 | Johansson et al. . | |
| 4,926,669 | 5/1990 | Grims et al. . | |
| 5,016,462 | 5/1991 | Grims et al. | 72/349 |
| 5,154,075 | 10/1992 | Hahn et al. . | |

*Primary Examiner*—Lowell A. Larson
*Assistant Examiner*—Rodney Butlar
*Attorney, Agent, or Firm*—Klaas, Law, O'Meara & Malkin, P.C.; Joseph J. Kelly

[57] ABSTRACT

Domer apparatus for forming desired surface contours on the closed end portion of a can body wherein an outer member is mounted for sliding movement in a direction parallel to the longitudinal axis of the domer apparatus and relative to an inner member and wherein the outer member and the inner member are mounted for movement in radial directions in response to forces applied thereto by the closed end portion of the can body to center the outer member and the inner member relative to the closed end portion of the can body.

20 Claims, 2 Drawing Sheets

DOMER APPARATUS FOR A CAN BODY MAKING APPARATUS

FIELD OF THE INVENTION

This invention relates generally to domer apparatus for use in forming the surface contours in the closed end portion of a can body and more specifically to domer apparatus that is mounted for movement in response to forces applied by the closed end portion so as to center the domer apparatus relative to the closed end portion of the can body.

BACKGROUND OF THE INVENTION

In the formation of can or container bodies, it is conventional to use domer apparatus for use in forming the desired surface contours in the closed end portion of the can body. In order to form the desired surface contours in the correct locations, it is necessary that the domer apparatus be centered relative to the closed end portion of the can body as the punch of the can body making apparatus moves the closed end portion into the domer apparatus. One type of commercial domer apparatus having an axially movable member and an axially fixed member is provided with adjusting apparatus to adjust the initial position of the axially movable member and the axially fixed member of the domer apparatus relative to the closed end portion of the can body on the punch. In this adjusting apparatus, four gibs, in contact with apparatus used to mount the axially movable and axially fixed members, are adjusted by a nut and screw to position the axially movable and axially fixed members relative to the closed end portion of the can body on the punch. The centering of the axially movable and axially fixed members is not always accomplished on the first attempt and generally takes many attempts. Also, the axially movable and axially fixed members require repositioning after the can body making apparatus has been in use for a period of time or a new supply of can blanks from which the can bodies are made is supplied to the apparatus or misalignment of the punch. Other conventional can body making apparatus use adjusting apparatus that meet with similar difficulties.

BRIEF DESCRIPTION OF THE INVENTION

This invention provides domer apparatus for forming desired surface contours in the closed end portion of a can body wherein a first outer member of a domer apparatus is mounted for sliding movement in a direction parallel to the longitudinal axis of the domer apparatus and relative to a second inner member of the domer apparatus and wherein the first and second members are mounted for movement in generally radial directions in response to forces applied thereto by the closed end portion of the can body on the punch of the can body making apparatus so as to center the first and second members relative to the closed end portion of the can body. After being centered, the first and second members remain as positioned until other forces are applied by another closed end portion of a can body to recenter the first and second members.

In a preferred embodiment of the invention, the domer apparatus has a longitudinal axis and comprises at least one axially movable outer member and at least one inner member which may or may not be moveable in an axial direction and wherein the at least one axially outer movable member has a generally ring shaped transverse cross-sectional configuration. The at least one axially movable outer member and the at least one inner member have coinciding longitudinal axes which extend in the same direction as the longitudinal axis of the domer apparatus. The at least one axially movable outer member and the at least one inner member are mounted on the domer apparatus for permitting movement thereof in radial directions relative to the longitudinal axis of the domer apparatus so that the at least one axially movable outer member and the at least one inner member may be centered by the closed end portion of a can body on the punch.

The domer apparatus has a central cavity having an inner surface having a longitudinal axis coinciding with the longitudinal axis of the domer apparatus. An axially slidable member has an outer surface in contact with the inner surface of the cavity. The axially slidable member has an axially inner surface and an axially outer surface and the at least one axially movable member has an axially inner surface and an axially outer surface. A portion of the axially outer surface of the axially slidable member is formed by the axially outer surface of an annular member secured in a recess in the axially outer surface of the axially slidable member. The axially outer surface of the at least one axially movable member is located to contact at least a portion of the closed end portion of the can body and at least a portion of the axially inner surface of the at least one axially movable member is in radial slidable contact with at least a portion of the axially outer surface of the axially slidable member. The at least one inner member has an axially inner surface and an axially outer surface. The axially outer surface of the at least one inner member is located to contact at least another portion of the bottom surface of the can body and at least a portion of the axially inner surface of the at least one inner member being is located for movement into slidable contact with at least a portion of the at least a portion of the axially outer surface of the axially slidable member. The at least one axially movable member and the axially slidable member are resiliently connected together. In a preferred embodiment of the invention, the at least one axially movable member and the axially slidable member are connected together by apparatus which comprises an annular holding member having an axially inner surface spaced from the axially outer surface of the axially slidable member and the annular member. A radially inwardly extending flange is formed on the annular holding member and has an axially inner surface in contact with at least portions of the axially outer surface of the at least one axially movable member. The annular holding member has a generally cylindrical inner surface and the at least one axially movable member has a generally cylindrical outer surface. The generally cylindrical inner surface has a diameter greater than the diameter of the generally cylindrical outer surface to permit the movement of the at least one axially movable member in radial directions. The annular holding member has a plurality of circumferentially spaced apart opening formed therein with each of the plurality of openings having a longitudinal axis extending generally in a direction parallel to the longitudinal axis of the domer apparatus. A threaded bolt having an enlarged head portion extends through each of the plurality of openings and is threadedly secured in threaded openings in the axially slidable member or an attachment thereof. Resilient means was provided for urging the facing surfaces of the at least one axially movable member and the axially slidable member and the annular member into a contacting relationship. In a preferred embodiment of the invention, the resilient means comprises a belleville washer located between an axially outer surface of the annular holding member and the enlarged head portion of each of threaded bolts. However, it is understood that other types of structures may be used to provide the desired resilient force.

In the preferred embodiment of the invention, the at least one axially movable member has a generally cylindrical inner surface and the at least one inner member has a generally cylindrical outer surface in contact with the generally cylindrical inner surface of the at least one axially movable member but permitting relative sliding movement therebetween. The domer apparatus further comprises a generally central stem portion mounted at a fixed location on the domer apparatus. Connecting means are provided for connecting the at least one inner member to the generally central stem portion for permitting the movement of the at least one inner member in the radial directions relative to the stem portion. In a preferred embodiment of the connecting means, the stem portion has an axially outer end portion having a surface extending generally in a radial direction relative to the longitudinal axis of the domer apparatus. An annular spacer having an axially inner surface and an axially outer surface is mounted so that at least a portion of the axially inner surface of the annular spacer is in contact with at least a portion of the surface of the axially outer end portion of the stem portion. A block has a first portion having a generally cylindrical outer surface and a second portion having a generally cylindrical outer surface. The generally cylindrical outer surface of the first portion has a diameter greater than the diameter of the generally cylindrical surface of the second portion. The first portion has an axially inner surface extending generally in a radial direction relative to the longitudinal axis of said domer apparatus and is mounted so that at least a portion of the axially inner surface of the first portion is in contact with at least a portion of the axially outer surface of the annular spacer. The at least one inner member has a cavity having an axially inwardly facing surface extending generally in a radial direction relative to the longitudinal axis of the domer apparatus. The first portion has an axially outer surface having at least portions thereof in contact with at least portions of the axially inwardly facing surface of the cavity of the at least one inner member and the second portion has an axially inwardly facing surface extending generally in a radial direction relative to the longitudinal axis of the domer apparatus. An annular washer having an axially inner surface and an axially outer surface is positioned so that at least portions of the axially inwardly facing surface of the second portion is in contact with at least portions of the axially outer surface of the annular washer. Resilient means are provided to urge the at least portions of the axially outer surface of the annular washer into contact with the at least a portion of the axially inner surface of the annular spacer to permit radial movement of the inner member. First securing means are provided for securing the annular spacer to the stem portion; second securing means are provided for securing the first portion to the at least one inner member; and third securing means are provided to restrain axial movement of the inner member relative to the stem portion but to permit radial movement of the inner member relative to the stem portion.

BRIEF DESCRIPTION OF THE DRAWING

An illustrative and presently preferred embodiment of the invention is illustrated in the drawing in which.

DETAILED DESCRIPTION OF THE INVENTION

Figure 1:
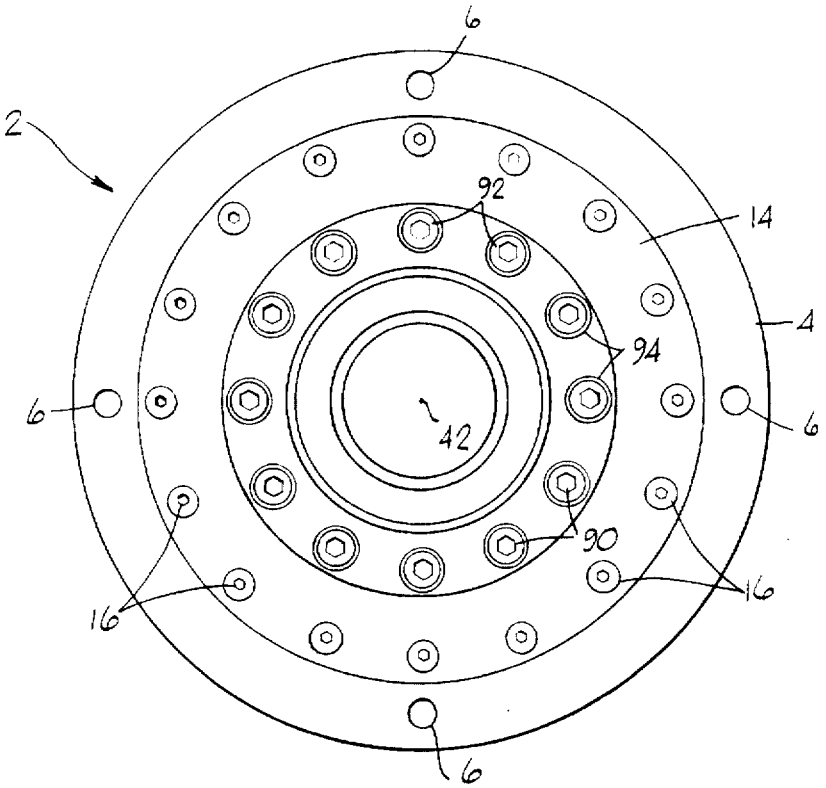
FIG. 1 is a front elevational view of the domer apparatus of this invention.

In FIGS. 1–4, there is illustrated domer apparatus 2 of this invention having a housing 4 having a plurality of openings 6 formed in a flange portion 8 thereof so that the housing 4 can be mounted at a fixed location on the frame (not shown) of a can body making apparatus in a conventional manner. A cylindrical sleeve 10 is fixedly mounted in the housing 4 between a fixed abutment 12 and a cylindrical sleeve 13 which abuts against a mounting plate 14 which is secured to the housing 4 by a plurality of threaded bolts 16. An axially slidable member 18 having cylindrical outer 20 and inner 22 surfaces is mounted for sliding movement relative to the cylindrical sleeve 10. An annular wear plate 24 is mounted on the axially inner surface 26 of the slidable member 18 by a plurality of threaded bolts 28.

A generally central stem portion 30 is mounted at a fixed location in the domer apparatus 2 by a fixed cylindrical block 32 and threaded bolt 34. In the preferred embodiment of the invention, the central stem portion is mounted in the domer apparatus 2 at a fixed location but, as explained below, may also be mounted for reciprocal movement in axial directions. The stem portion 30 has a first generally cylindrical outer surface 36 and a second generally cylindrical outer surface 38. The first generally cylindrical outer surface 36 has a diameter greater than the diameter of the second generally cylindrical outer surface 38 so as to form an abutment shoulder 40 to limit the axial inward movement of the slidable member 18. The domer apparatus 2, the slidable member 18 and the stem portion 30 preferably have the same longitudinal axis 42, FIG. 4. A chamber 44 surrounds the stem portion 30 and air under pressure is fed into the chamber 44 through an air passageway 46 to urge the slidable member 18 in an axially outward direction. The axially outward movement of the slidable member 18 is limited by an abutment surface 48 on an annular member 50 secured to the axially outer surface 51 of the slidable member 18 by threaded bolts 53 and an abutment surface 52 on the mounting plate 14. The annular member 50 has an axially outer surface 54 extending in a radial direction relative to the longitudinal axis 42.

The doming portion of the domer apparatus 2 comprises an annular member 60 which is mounted for reciprocal movement in axial directions parallel to the longitudinal axis 42. In some instances, there may be more than one axially movable annual member 60. An inner member 62 is preferably mounted at a fixed location and has an outer surface over which the annular member 60 slides, as described below. In some instances, such as in U.S. Pat. No. 5,154,075 (which is incorporated herein by reference thereto), the inner member 62 is mounted for reciprocal movement in axial directions parallel to the longitudinal axis 42.

Figure 2:
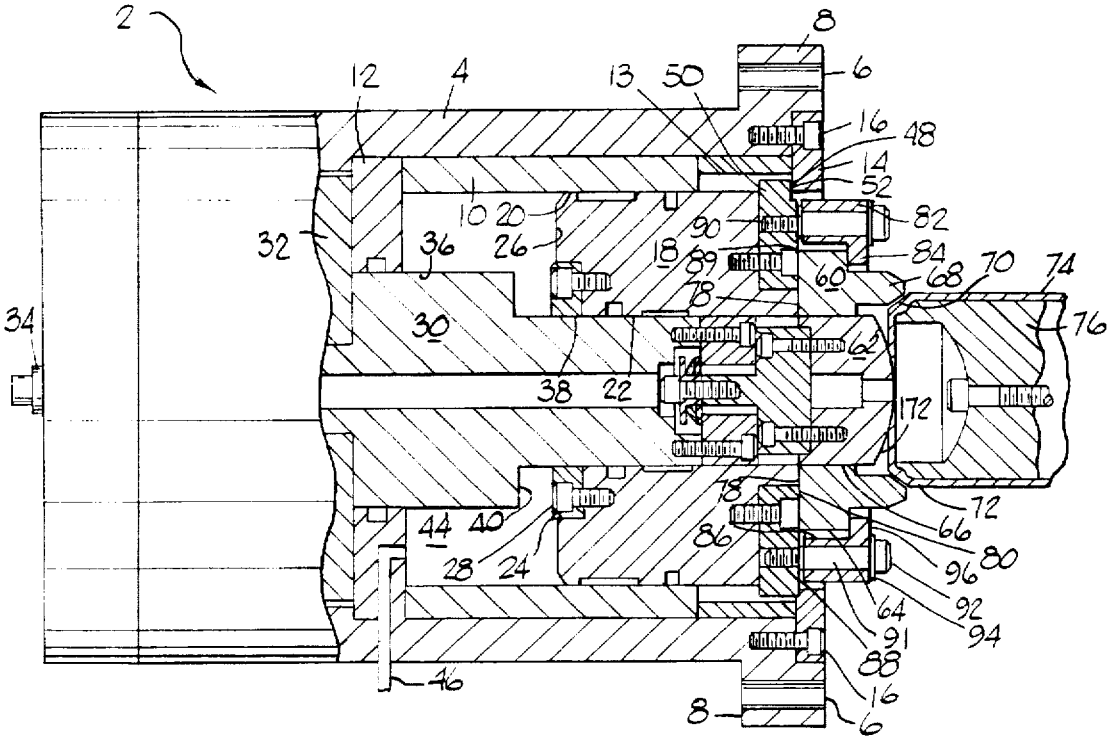
FIG. 2 is a side elevational view with parts in section of the domer apparatus of this invention.
Figure 3:
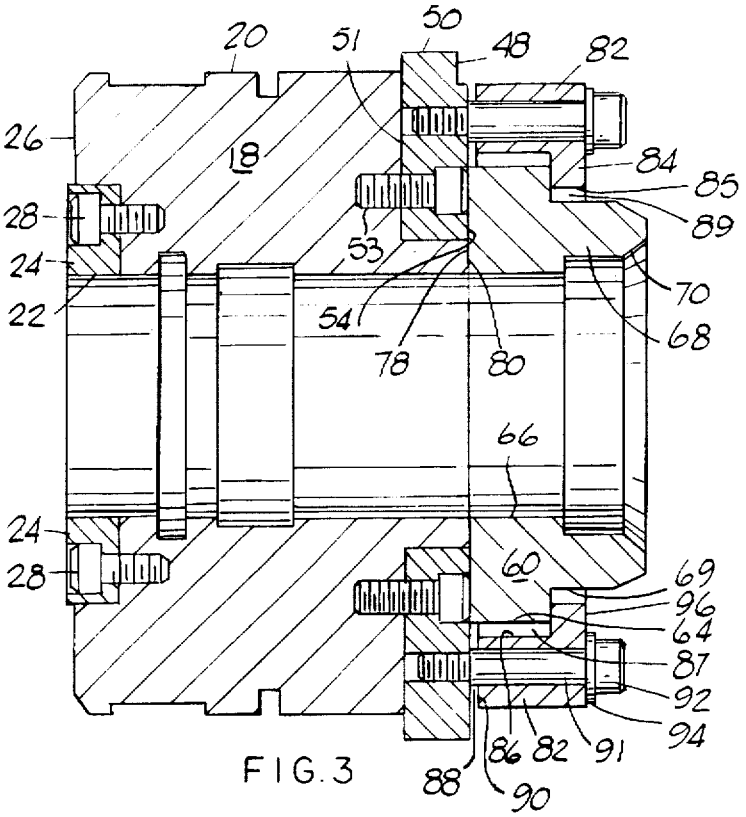
FIG. 3 is an enlarged side elevational view with parts in section of the at least one axially movable member of this invention.

The annular member 60, illustrated particularly in FIGS. 2 and 3, has a generally cylindrical outer 64 and inner 66 surfaces. The annular member 60 has an axially outwardly projecting annular portion 68 having a desired surface contour 70 for contacting a portion of the closed end portion 72 of the can body 74 carried on the end of a punch 76 of a can body making apparatus (not shown). The slidable member 18 has an axially outer surface 78 extending generally in a radial direction. The annular member 60 has an axially inner surface 80 extending in a radial direction and portions thereof are resiliently urged into contact with portions of the axially outer surfaces 54 and 78 to permit sliding movement therebetween in generally radial directions. While a variety of resilient means can be used to obtain the desired relative sliding movement, the preferred resilient means comprises an annular holding member 82 having a radially inwardly projecting flange portion 84 and a generally cylindrical inner surface 86 spaced from the generally cylindrical outer surface 64 to provide an annular space 87 to allow for the radial movement of the annular member 60. The generally cylindrical outer surface 64 has an axial extent greater than the axial extent of the generally cylindrical inner surface 86 to provide an annular space 88 between the axially outer surface 78 and the axially inner surface 90 of the annular member 60. The flange portion 84 has a generally cylindrical inner surface 85 and the annular projection 68 has a generally cylindrical outer surface 69 that is spaced from the generally cylindrical inner surface 85 to provide an annular space 89. The annular spaces 87 and 89 permit the movement of the annular member 60 in generally radial directions relative to the longitudinal axis 42 as explained below. The annular holding member 82 is connection to the slidable member 18 by a plurality of threaded bolts 91 having an enlarged head portions 92. A belleville washer 94 is mounted between the enlarged head portion 92 of each threaded bolt 90 and an annular surface 96 of the annular holding member 82 to provide the resilient force holding the axially inner surface 80 against the axially outer surface 78. Other types of apparatus such as a wafer spring or an O-ring, can be positioned between the facing surfaces of the flange portion 84 and the annular member 60 to provide the resilient force.

Figure 4:
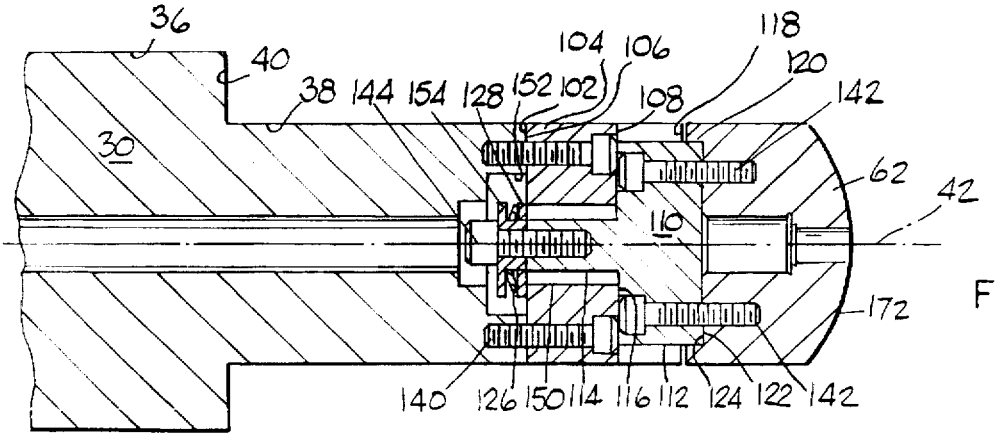
FIG. 4 is an enlarged side elevational view with parts in section of the at least one inner member of this invention.
Figure 4A:
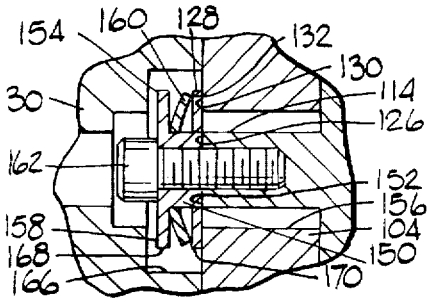
FIG. 4*a* is an enlarged view of a section of FIG. 4.

The construction of the inner member 62 is illustrated particularly in FIGS. 4 and 4*a*. The stem portion 30 has an axially outer end surface 102 extending generally in a radial direction relative to the longitudinal axis 42 of the domer apparatus 2. An annular spacer 104 has an axially inner surface 106 and an axially outer surface 108. At least a portion of the axially inner surface 106 is in contact with at least a portion of the axially outer surface 102. A block 110 has a first portion having a generally cylindrical outer surface 112 and a second portion having a generally cylindrical outer surface 114. The generally cylindrical outer surface 112 has a diameter greater than he generally cylindrical outer surface 114. The first portion has a axially inner surface 116 extending generally in a radial direction relative to the longitudinal axis 42 of the domer apparatus 2. At least portions of the axially inner surface 116 of the first portion are in contact with at least portions of the axially outer surface 108 of the annular spacer 104. The inner member 62 has an axially inner surface 118 having a recess 120 formed therein. The recess 120 has an axially inwardly facing surface 122 extending generally in a radial direction relative to the longitudinal axis 42 of the domer apparatus 2. The first portion has an axially outer surface 124 having at least portions thereof in contact with at least portions of the axially inner surface 122 of the inner member 62. The second portion of the block 110 has an axially inwardly facing surface 126 extending generally in a radial direction relative to the longitudinal axis 42 of the domer apparatus 2. An annular washer 128 has an axially inner surface 130 and an axially outer surface 132 each extending generally in a radialdirection relative to the longitudinal axis 42 of the dome apparatus 2. First securing means, comprising a plurality of threaded bolts 140, secure the annular spacer 104 to the stem portion 30. Second securing means, comprising a plurality of threaded bolts 142, secure the first portion of the block 110 to the inner member 62.

Third securing means are provided to restrain the axial movement of the inner member 62 relative to the stem portion 30 but to permit radial movement of the inner member 62 relative to the stem portion 30. The third securing means comprise a central body portion 150 having an axially inner surface 152 for contact with the axially inwardly facing surface 126 of the second portion of the block 110. The central body portion 150 has a radially outwardly projecting flange portion 154 having a diameter greater than the generally cylindrical inner surface 156 of the annular spacer 104. The flange portion 154 has an axially outer surface 158. Resilient means 160, such as a belleville washer, a wafer spring, a elastic O-ring or other resilient structures, are located between the axially outer surface 158 and the axially inner surface 132. A headed threaded bolt 162 passes through the central body portion 150, the resilient means 160 and the annular washer 128 and is threaded into the second portion of the block 110. When the headed threaded bolt 162 moves the axially outer surface 152 into contact with the axially inwardly facing surface 126 of the second portion of the block 110, the flange portion 154 applies a force on the resilient means 160 to apply a resilient pressure on the annular washer 128 to restrain the axial movement of the inner member 62 relative to the stem portion 30 but to permit relative radial movement of the inner member 62 relative to the stem portion 30.

The generally cylindrical inner surface 156 of the annular spacer 104 is spaced from the generally cylindrical outer surface 114 of the first portion and the stem portion 30 has a generally cylindrical inner surface 166 that is spaced from the generally cylindrical outer surface 168 of the flange portion 154 and the generally cylindrical outer surface 170 of the annular washer 128 to permit radial movement of the second portion of the block 110 and therefore the radial movement of the inner member 62 relative to the stem portion 30.

In operation, the punch 76 moves the closed end portion 72 of the can body 74 into contact with the contoured surface 70 of the annular member 60. It is understood that the contour of the surface 70 can be of any desired configuration. As the movement of the punch 76 continues, if the annular member 60 is not centered relative to the closed end portion 72, the closed end portion 72 will apply continuing forces on the annular member 60 to move both the annular member 60 and the inner member 62 in generally radial directions so that by the time that the closed end portion 72 contacts the outer dome surface 172 of the inner member 62, the annular member 60 and the inner member 62 will be centered relative to the closed end portion 72. It is understood that the dome surface 172 can be of any desired configuration. The resilient force applied by the belleville washers 94 and the resilient means 160 will hold the annular member 60 and the inner member 62 in the adjusted position until the closed end portion 72 of another can body 74 applies centering forces on the annular member 60.

It is contemplated that the inventive concepts herein described may be variously otherwise embodied and it is intended that the appended claims be construed to include alternative embodiments of the invention except insofar as limited by the prior art.

What is claimed is:

1. Apparatus for use in positioning a domer apparatus for use in forming desired surface contours on the closed end portion of a can body comprising:

domer apparatus having a longitudinal axis;

said domer apparatus having at least one axially movable outer member and at least one inner member;

said at least one axially movable outer member having a central opening having an inner surface;

said at least one inner member being located in said central opening for permitting relative sliding movement between said axially movable member and said at least one inner member;

said at least one axially movable member and said at least one inner member having coinciding longitudinal axes extending in the same direction as said longitudinal axis of said domer apparatus;

mounting means for mounting said at least one axially movable member and said at least one inner member for permitting movement thereof in generally radial directions relative to said longitudinal axis of said domer apparatus to a new location when a sufficient force is applied thereto;

said domer apparatus having a central cavity having an inner surface having a longitudinal axis coinciding with said longitudinal axis of said domer apparatus;

an axially slidable member having an outer surface in contact with said inner surface;

said axially slidable member having an axially inner surface and an axially outer surface;

said at least one axially movable member having an axially inner surface and an axially outer surface;

said axially outer surface of said at least one axially movable member being located to contact at least a portion of said bottom surface of said can body;

at least a portion of said axially inner surface of said at least one axially movable member being in slidable contact with at least a portion of said axially outer surface of said axially slidable member for permitting movement of said at least one axially movable member in radial directions;

said at least one inner member having an axially inner surface and an axially outer surface;

said axially outer surface of said at least one inner member being located to contact at least another portion of said closed end portion of said can body; and at least a portion of said axially inner surface of said at least one inner member being located for movement in radial directions into slidable contact with at least a portion of said at least a portion of said axially outer surface of said axially slidable member.

2. Apparatus as in claim 1 and further comprising:

connecting means connection said axially slidable member to said at least one axially movable member for movement therewith.

3. Apparatus as in claim 1 and further comprising:

said at least one axially movable member having a generally cylindrical inner surface; and said at least one inner member having a generally cylindrical outer surface in contact with said generally cylindrical inner surface but permitting relative sliding movement therebetween.

4. Apparatus as in claim 1 and further comprising:

said mounting means also retaining said at least one axially movable member and said at least one inner member at said new location until they are moved again by another sufficient force applied thereto.

5. Apparatus as in claim 2 and further comprising:

resilient means for urging said axially inner surface of said at least one axially movable member into contact with said at least a portion of said axially outer surface of said axially slidable member.

6. Apparatus as in claim 2 wherein said connection means comprise:

an annular holding member having an axially inner surface spaced from the plane of said axially outer surface of said axially slidable member;

a radially inwardly extending flange on said annular holding member an having an axially inner surface in contact with at least portions of said axially outer surface of said at least one axially movable member;

said annular holding member having a generally cylindrical inner surface;

said at least one axially movable member having a generally cylindrical outer surface;

said generally cylindrical inner surface having a diameter greater than the diameter of said generally cylindrical outer surface to permit said movement of said at least one axially movable member in said radial directions;

said annular holding member having a plurality of circumferentially spaced apart openings formed therein;

each of said plurality of openings having a longitudinal axis extending generally in a direction parallel to said longitudinal axis of said domer apparatus; and a threaded bolt having an enlarged head portion extending through each of said plurality of openings and threadedly secured in threaded openings in said slidable member.

7. Apparatus as in claim 6 and further comprising:

resilient means for urging said axially inner surface of said at least one axially movable member into contact with said at least a portion of said axially outer surface of said axially slidable member.

8. Apparatus as in claim 7 wherein said resilient means comprise:

said annular holding member having an axially outer surface; and a belleville washer between said enlarged head portion of each of said threaded bolts and said axially outer surface of said annular holding member.

9. Apparatus as in claim 3 and further comprising:

a generally central stem portion mounted on said domer apparatus; and connecting means for connecting said at least one inner member to said generally central stem portion for restraining axial movement of said at least one inner member relative to said generally central stem portion but permitting said movement of said at least one inner member in said radial directions relative to said generally central stem portion.

10. Apparatus as in claim 9 wherein said connecting means comprise:

said stem portion having an axially outer surface extending generally in a radial direction relative to said longitudinal axis of said domer apparatus;

an annular spacer having an axially inner surface and an axially outer surface;

at least a portion of said axially inner surface of said annular spacer being in contact with at least a portion of said axially outer surface of said stem portion;

a block having a first portion having a generally cylindrical outer surface and a second portion having a generally cylindrical outer surface having a diameter smaller than the diameter of said generally outer surface of said first portion;

said first portion having an axially inner surface extending generally in a radial direction relative to said longitudinal axis of said domer apparatus;

at least a portion of said axially inner surface of said first portion being in contact with at least a portion of said axially outer surface of said annular spacer;

said at least one inner member having an axially inner surface having a recess formed therein, said recess having an axially inwardly facing surface extending generally in a radial direction relative to said longitudinal axis of said domer apparatus;

said first portion having an axially outer surface having at least portions thereof in contact with at least portions of said axially inwardly facing surface of said cavity of said at least one inner member;

said second portion having an axially inwardly facing surface extending generally in a radial direction relative to said longitudinal axis of said domer apparatus;

an annular washer having an axially inner surface and an axially outer surface;

at least portions of said axially outer surface of said annular washer being in contact with portions of said axially inner surface of said annular spacer;

first securing means for securing said annular spacer to said stem portion;

second securing means for securing said first portion to said at least one inner member; and third securing means mounted on said second portion for restraining axial movement of said inner member relative to said generally central stem portion but permitting radial movement of said inner member relative to said generally central stem portion.

11. Apparatus as in claim 10 and further comprising:

said domer apparatus having a central cavity having an inner surface having a longitudinal axis coinciding with said longitudinal axis of said domer apparatus;

an axially slidable member having an outer surface in contact with said inner surface;

said axially slidable member having an axially inner surface and an axially outer surface;

said at least one axially movable member having an axially inner surface and an axially outer surface;

said axially outer surface of said at least one axially movable member being located to contact at least a portion of said bottom surface of said can body;

at least a portion of said axially inner surface of said at least one axially movable member being in slidable contact with at least a portion of said axially outer surface of said axially slidable member for permitting movement of said at least one axially movable member in radial directions;

said at least one inner member having an axially inner surface and an axially outer surface;

said axially outer surface of said at least one inner member being located to contact at least another portion of said bottom surface of said can body; and at least a portion of said axially inner surface of said at least one inner member being located for movement into slidable contact with at least a portion of said at least a portion of said axially outer surface of said axially slidable member.

12. Apparatus as in claim 11 and further comprising:

connecting means connection said axially slidable member to said at least one axially movable member for movement therewith.

13. Apparatus as in claim 12 and further comprising:

resilient means for urging said axially inner surface of said at least one axially movable member into contact with said at least a portion of said axially outer surface of said axially slidable member.

14. Apparatus as in claim 12 and further comprising:

resilient means for urging said axially inner surface of said at least one axially movable member into contact with said at least a portion of said axially outer surface of said axially slidable member.

15. Apparatus as in claim 13 wherein said connection means comprise:

an annular holding member having an axially inner surface spaced from the plane of said axially outer surface of said axially slidable member;

a radially inwardly extending flange on said annular holding member an having an axially inner surface in contact with at least portions of said axially outer surface of said at least one axially movable member;

said annular holding member having a generally cylindrical inner surface;

said at least one axially movable member having a generally cylindrical outer surface;

said generally cylindrical inner surface having a diameter greater than the diameter of said generally cylindrical outer surface to permit said movement of said at least one axially movable member in said radial directions;

said annular holding member having a plurality of circumferentially spaced apart openings formed therein;

each of said plurality of openings having a longitudinal axis extending generally in a direction parallel to said longitudinal axis of said domer apparatus; and a threaded bolt having an enlarged head portion extending through each of said plurality of openings and threadedly secured in threaded openings in said slidable member.

16. Apparatus as in claim 14 wherein said resilient means comprise:

said annular holding member having an axially outer surface; and a belleville washer between said enlarged head portion of each of said threaded bolts and said axially outer surface of said annular holding member.

17. Apparatus for using in positioning a domer apparatus of a can body comprising:

domer apparatus having a longitudinal axis;

said domer apparatus comprising at least one axially movable member and at least one inner member;

said at least one axially movable member having a ring shaped transverse cross-sectional configuration;

said at least one axially movable member and said at least one inner member having coinciding longitudinal axes extending in the same direction as said longitudinal axis of said domer apparatus;

said at least one axially movable member and said at least one inner member being mounted on said domer apparatus for permitting movement thereof in generally radial directions relative to said longitudinal axis of said domer apparatus to a new location when a sufficient force is applied thereto;

said domer apparatus having a central cavity having an inner surface having a longitudinal axis coinciding with said longitudinal axis of said domer apparatus;

an axially slidable member having an outer surface in contact with said inner surface;

said axially slidable member having an axially inner surface and an axially outer surface;

said at least one axially movable member having an axially inner surface and an axially outer surface;

said axially outer surface of said at least one axially movable member being located to contact at least a portion of said bottom surface of said can body;

at least a portion of said axially inner surface of said at least one axially movable member being in slidable contact with at least a portion of said axially outer surface of said axially slidable member for permitting movement of said at least one axially movable member in radial directions;

said at least one inner member having an axially inner surface and an axially outer surface;

said axially outer surface of said at least one inner member being located to contact at least another portion of said bottom surface of said can body; and at least a portion of said axially inner surface of said at least one inner member being located for movement in radial directions into slidable contact with at least a portion of said at least a portion of axially outer surface of said axially slidable member.

18. Apparatus as in claim 17 and further comprising:

said axially slidable member being connected to said at least one axially movable member for movement therewith.

19. Apparatus as in claim 17 and further comprising:

said mounting means also retaining said at least one axially movable member and said at least one inner member at said new location until they are moved again by another sufficient force applied thereto.

20. Apparatus as in claim 18 and further comprising:

said axial inner surface of said at least one axially movable member being resiliently urged into contact with said at least a portion of said axially outer surface of said axially slidable member; and resilient means for connecting said at least one inner member to said domer apparatus to restrain movement of said at least one inner member in an axial direction relative to said domer apparatus but to permit movement of said at least one inner member for movement in radial directions relative to said domer apparatus.

* * * * *